US007242787B2

(12) United States Patent
D'Hoogh

(10) Patent No.: US 7,242,787 B2
(45) Date of Patent: Jul. 10, 2007

(54) ELECTROMAGNETIC DRIVING UNIT FOR A LOUDSPEAKER ASSEMBLY

(75) Inventor: Guido Odilon Maurits D'Hoogh, Dendermonde (BE)

(73) Assignee: PSS Belgium, N.V., Dendermonde (BE)

( * ) Notice: Subject to any disclaimer, the term of this patent is extended or adjusted under 35 U.S.C. 154(b) by 225 days.

(21) Appl. No.: 10/511,975

(22) PCT Filed: Mar. 20, 2003

(86) PCT No.: PCT/IB03/01159

§ 371 (c)(1),
(2), (4) Date: Oct. 20, 2004

(87) PCT Pub. No.: WO03/092323

PCT Pub. Date: Nov. 6, 2003

(65) Prior Publication Data

US 2005/0163327 A1 Jul. 28, 2005

(30) Foreign Application Priority Data

Apr. 25, 2002 (EP) ..... 02076650

(51) Int. Cl.
*H04R 25/00* (2006.01)

(52) U.S. Cl. ..... 381/412; 381/414; 381/421

(58) Field of Classification Search ..... 381/396, 381/59, 412–414, 416, 420–422, 398, 400, 381/403–405, 419, 401, 402, 96; 181/163–166, 181/171–172; 335/302, 306
See application file for complete search history.

(56) References Cited

U.S. PATENT DOCUMENTS

| | | | | |
|---|---|---|---|---|
| 4,737,992 | A * | 4/1988 | Latham-Brown et al. | 381/404 |
| 5,594,805 | A * | 1/1997 | Sakamoto et al. | 381/412 |
| 5,734,131 | A * | 3/1998 | Sakamoto | 181/141 |
| 5,848,174 | A * | 12/1998 | Ki et al. | 381/404 |
| 5,949,898 | A * | 9/1999 | Proni | 381/398 |
| 6,151,402 | A * | 11/2000 | Azima et al. | 381/396 |
| 6,173,065 | B1 * | 1/2001 | Lin | 381/398 |
| 6,332,029 | B1 * | 12/2001 | Azima et al. | 381/152 |

FOREIGN PATENT DOCUMENTS

| | | |
|---|---|---|
| JP | 1023591 A | 1/1998 |
| JP | 2001 78293 A | 3/2001 |
| JP | 2002300694 A | 10/2002 |
| WO | WO9966763 | 12/1999 |

* cited by examiner

*Primary Examiner*—Huyen Le
(74) *Attorney, Agent, or Firm*—Sheehan, Phinney, Bass & Green, P.A.; Peter A. Nieves

(57) ABSTRACT

An electromagnetic driving unit includes a magnet part and a coil part that is translatable along a translation axis with respect to the magnet part. A diaphragm extends from the coil part in a substantially radial direction with respect to the translation axis of the coil part. The magnet part includes two permanent magnets and an intermediate magnetic pole element that is sandwiched between the permanent magnets when viewed along the translation axis of the coil part. In order to improve the efficiency of the driving unit, the permanent magnets and the intermediate magnetic pole element are sandwiched between two external magnetic pole elements, and all pole elements have pole faces that are magnetically directed towards the coil part.

16 Claims, 3 Drawing Sheets

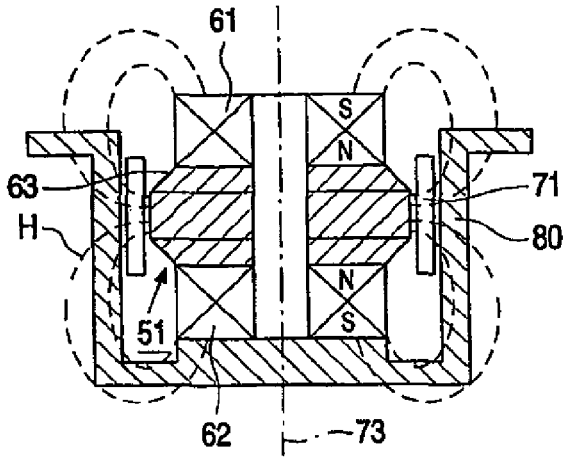
FIG. 3 [PRIOR ART]
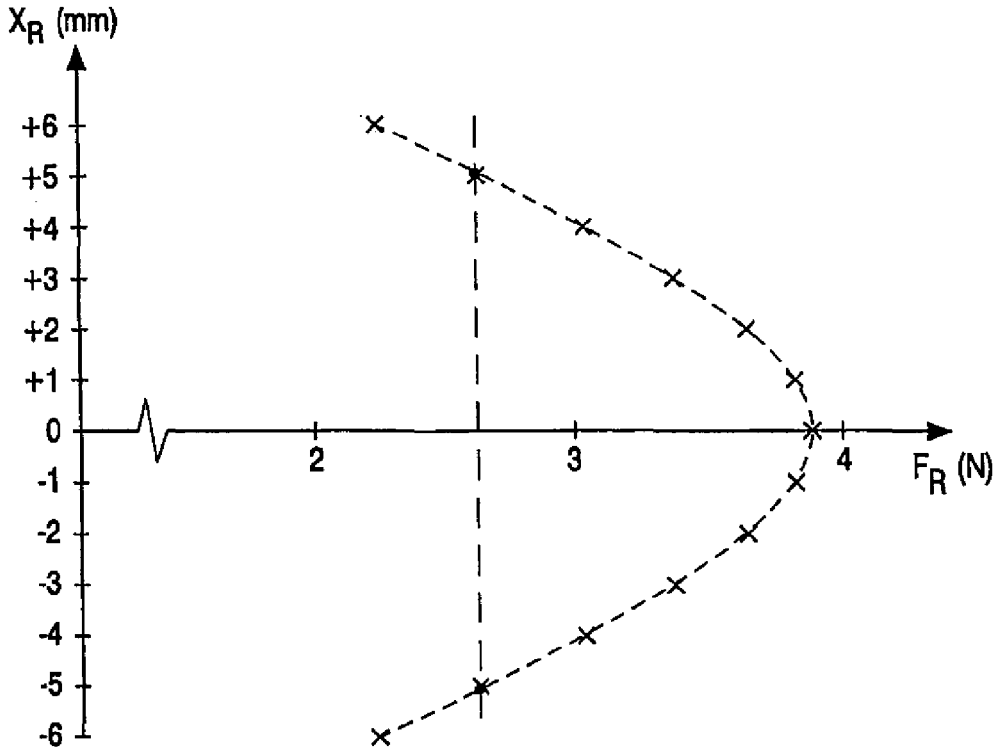
FIG. 4

ELECTROMAGNETIC DRIVING UNIT FOR A LOUDSPEAKER ASSEMBLY

The invention relates to an electromagnetic driving unit, particularly designed for a loudspeaker assembly, which driving unit comprises a magnet part and a driving coil part for magnetic cooperation with the magnet part, the coil part being translatable along a translation axis with respect to the magnet part, the magnet part comprising two permanent magnets and an intermediate magnetic pole element which is sandwiched between the permanent magnets when viewed along the translation axis of the coil part, the intermediate magnetic pole element having a pole face which is magnetically directed towards the coil part.

The invention further relates to a loudspeaker assembly provided with a frame, a diaphragm, and a driving unit of the above-described type.

JP-A 2001 78293 discloses a planar loudspeaker assembly of the repulsion magnetic circuit type, which is provided with an electromagnetic driving unit consisting of a magnetic device and a voice coil surrounding the magnetic device with clearance. The magnetic device is composed of two oppositely magnetized permanent magnets placed one above the other and a magnetic plate placed in-between these magnets. The voice coil is placed opposite to an outer circumferential part of the magnetic plate. The loudspeaker has a flat diaphragm extending from the voice coil to a frame. The diaphragm is adhered to the voice coil at an inner edge and fixed to the frame via a suspension means at an outer edge.

A favorable aspect of the known loudspeaker is its small height. However, the driving unit of the known loudspeaker suffers from a relatively low efficiency owing to the relatively long flux paths associated with the applied magnetic device, or in other words owing to a relatively high magnetic reluctance of the magnetic device. Due to this disadvantage the known loudspeaker has only a limited range of application.

It is an object of the invention to improve the efficiency of the electromagnetic driving unit of the type described in the preamble.

This object is achieved by the driving unit according to the invention which comprises a magnet part and a coil part which is capable of magnetically cooperating with the magnet part, the coil part being translatable along a translation axis with respect to the magnet part, the magnet part comprising two permanent magnets and an intermediate magnetic pole element which is sandwiched between the permanent magnets when viewed along the translation axis of the coil part, the intermediate magnetic pole element having a pole face which is magnetically directed towards an inner face of the coil part, wherein the magnet part further comprises two external magnetic pole elements, the permanent magnets and the intermediate magnetic pole element being sandwiched between the external magnetic pole elements, which have pole faces which are magnetically directed towards an outer face of the coil part.

Due to the presence of the two external magnetic pole elements, the magnetic flux paths outside the magnet part can be made relatively short, and less flux strays than is the case in the above described prior art loudspeaker. In other words, more flux can be transmitted from the permanent magnets to the coil part, resulting in a lower magnetic reluctance and thus in a higher efficiency. For the sake of clarity it is to be noted that the coil part comprises a coil, which is often referred to as voice coil.

In an embodiment of the driving unit according to the invention, the coil part is situated between the two magnetic pole elements. The flux density at the coil part is further increased by this measure, and thus the efficiency is further improved.

In a practical embodiment of the driving unit according to the invention, the coil part comprises a cylindrical coil having a coil axis which extends parallel to the translation axis of the coil part or which coincides with the translation axis of the coil part.

In a further practical embodiment the driving unit according to the invention, the two permanent magnets are magnetized in directions parallel to the translation axis of the coil part, the magnetization direction of the one magnet being opposed to the magnetization direction of the other magnet.

In another embodiment, the pole elements, i.e. the intermediate magnetic pole element and the external pole elements, are made of a soft-magnetic material. Preferably a ferromagnetic material.

An attractive embodiment of the driving unit according to the invention is characterized in that the pole faces of the external magnetic pole elements are formed by edge portions which are inclined towards the coil part, particularly towards the coil. In this embodiment, the flux paths outside the magnet part are further shortened, and the flux density at the coil is further increased.

A measure still further improving the driving unit according to the invention implies that the radial dimension of the pole face of the intermediate magnetic pole element increases from the permanent magnets towards a central portion of the intermediate magnetic pole element when viewed along the translation axis of the coil part. In this context, the pole face of the intermediate magnetic pole element may be a substantially convex surface.

A further object of the invention is to provide a loudspeaker system having a broad field of application.

This object is achieved by the loudspeaker assembly according to the invention, which is provided with a frame, a diaphragm, and an electromagnetic driving unit comprising a magnet part and a driving coil part which is capable of magnetically cooperating with the magnet part, the coil part being translatable along a translation axis with respect to the magnet part, the magnet part comprises two permanent magnets and an intermediate magnetic pole element which is sandwiched between the permanent magnets when viewed along the translation axis of the coil part, the intermediate magnetic pole element having a pole face which is magnetically directed towards an inner face of the coil part, wherein the magnet part further comprises two external magnetic pole elements, the permanent magnets and the intermediate magnetic pole element being sandwiched between the external magnetic pole elements, which have pole faces which are magnetically directed towards an outer face of the coil part. It has been proven that the applied driving unit increases both the maximum driving force and the −3dB value of the driving force in the loudspeaker assembly according to the invention with respect to the prior art device. As known, the −3dB value of the driving force is the characteristic value for the linearity of the driving unit. The above-mentioned features and the above-described effects offer the possibility to build a high-power loudspeaker assembly which is flat and light in weight. Such an assembly is suitable for incorporation into shallow housings, particularly in the automotive field where, apart from the confined available built-in space, the weight plays an important role.

In a practical embodiment of the loudspeaker assembly according to the invention, the diaphragm is fixed to the coil part in an area extending between the two external magnetic pole elements. Preferably, the diaphragm extends from the coil part in a substantially radial direction with respect to the translation axis of the coil part.

It is to be noted that the driving unit according to the invention, although meant for use in a loudspeaker assembly, may be used in other applications. For this reason the invention also relates to an electromagnetic driving unit suitable for a broad field of application and having the same features as defined in the set of Claims.

With reference to the Claims, it is to be noted that various characteristic features as defined in the set of Claims may occur in combination.

The above-mentioned and other aspects of the invention are apparent from and will be elucidated with reference to the embodiments described hereinafter by way of non-limitative example.

In the drawings:

FIG. 3 is a longitudinal sectional view schematically showing a driving unit not having two external magnetic pole elements;

FIG. 4 is a diagram similar to the diagram of FIG. 2, but relating to the driving unit disclosed in FIG. 3.

Figure 1:
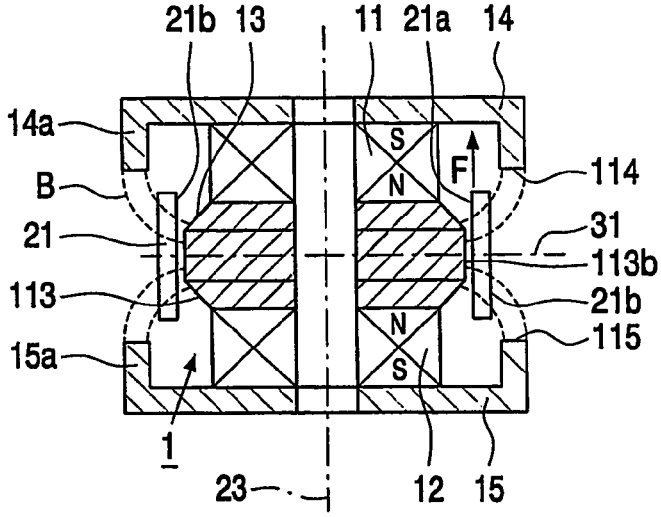
FIG. 1 is a longitudinal sectional view schematically showing an embodiment of the driving unit according to the invention.

The electromagnetic driving unit in accordance with the invention depicted in FIG. 1 comprises a magnet part 1 and a coil part 21. The magnet part 1 comprises two permanent magnets 11 and 12 made of a hard-magnetic material, such as NdFeB, and being oppositely magnetized as indicated in the drawing by the letters S (south pole) and N (north pole). The magnets 11 and 12 may be cylindrical bodies. The magnet part 1 further comprises an intermediate magnetic pole element 13 made of a ferromagnetic material, such as low-carbon steel, soft iron, and being positioned between and in contact with the magnets 11 and 12. The intermediate element 13 may be a round body. Furthermore, the magnet part 1 comprises two external magnetic pole elements 14 and 15 made of a ferromagnetic material, such as low-carbon steel, soft iron, which external pole elements 14 and 15 are arranged such that the assembly of the magnets 11 and 12 and the intermediate pole element 13 is sandwiched between the two external elements 14 and 15. The external elements 14 and 15 may be disc-shaped bodies.

The coil part 21, which extends around the intermediate element 13, is movably supported so as to be translatable along a translation axis 23. In this example the coil part 21 is attached to a diaphragm 31 which is movably suspended in a frame of a loudspeaker assembly, but other supporting or bearing devices, which may be known per se, are possible for supporting or bearing the coil part 21.

The coil part 21 in this example comprises a cylindrical coil whose coil axis coincides with the translation axis 23. The intermediate magnetic pole element 13 has a pole face 113 which is directed towards an inner face 21*a* of the coil part 21 and which in this example has a radial dimension that increases from the magnets 11 and 12 towards a central portion 113*b* of the pole face, viewed along the translation axis 23. The two external magnetic pole elements 14 and 15 each have a pole face 114, 115, respectively, magnetically directed towards an outer pole face 21*b* to the coil part 21. The pole faces 114 and 115 are formed by edge portions 14*a* and 15*a*, respectively, which incline towards the coil part 21. Due to the external pole element the arrangement of the coil extends in an area having a magnetic flux density—see flux lines B in the drawings—, which is high with respect to the flux densities in corresponding areas of known devices. During use of the driving unit in accordance with the invention, the coil of the coil part 2 is electrically connected to a current source.

When a current is flowing through the coil, a driving force, diagrammatically indicated by the letter F in the drawings, is generated in one of the translation directions due to magnetical cooperation between the coil part 21 and the magnet part 1.

Figure 2:
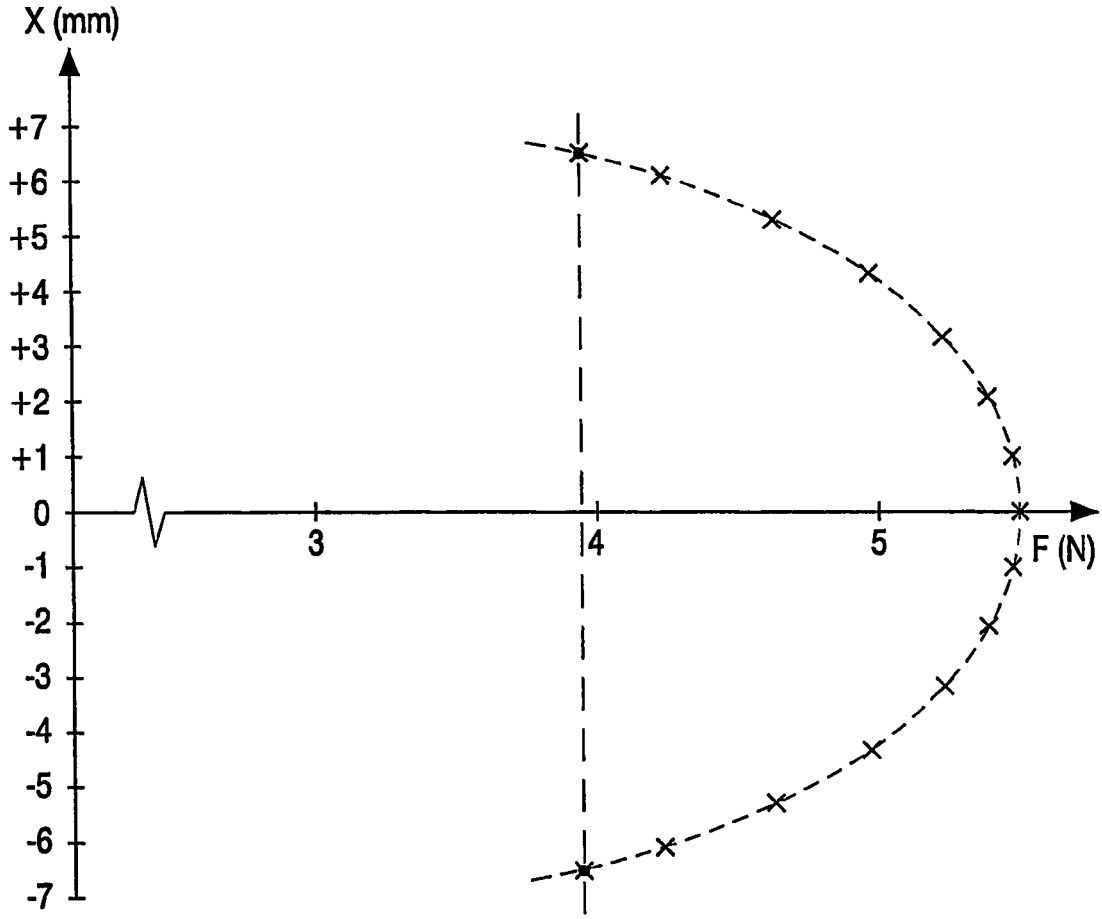
FIG. 2 is a diagram relating to the embodiment shown in FIG. 1, plotting the driving force of the driving unit as a function of the position of the coil part of the driving unit.

The diagram of FIG. 2 shows the driving force F generated by the driving unit depicted in FIG. 1 during energizing as a function of the position of the coil part 21 with respect to the magnetic part 1. The driving force F is indicated in newtons (N) along the horizontal axis. The position of the coil part about its mid-position, as depicted in FIG. 1, is indicated in millimeters (mm), along the vertical axis. As can be derived from the diagram, the driving force F in this example has a maximum value of 5.5 N and the displacement x of the coil part is 2×6.5 mm=13 mm at the −3 dB value (being 0.707×maximum value).

In order to show the surprising effects of the driving unit in accordance with the invention, a comparison will be made between the embodiment depicted in FIG. 1 and the embodiment depicted in FIG. 3.

The driving unit depicted in FIG. 3 comprises a magnetic part 51 formed by two permanent magnets 61 and 62 identical to the magnets 11 and 12 of the embodiment of FIG. 1, and an intermediate magnetic pole element 63 identical to the pole element 13 of the embodiment of FIG. 1, the intermediate pole element 63 being sandwiched between the two magnets 61 and 62. The driving unit further comprises a coil part 71 identical to the coil part 21 of the embodiment of FIG. 1 and is meant for magnetical cooperation with the magnetic part 51. The coil part 21 is translatable with respect to the magnetic part 51 along its coil axis 73. The driving unit is mounted in a frame 80 made of aluminum which serves as a mounting and cooling body. The flux lines generated by the permanent magnets 61 and 62 are indicated by the letter H.

The diagram of FIG. 4 shows the driving force $F_R$—generated by the driving unit depicted in FIG. 3 when the coil of the coil part 71 is energized—as a function of the position of the coil part 71 with respect to the magnetic part 51. The driving force $F_R$ is indicated in newtons (N) along the horizontal axis. The position of the coil part, which corresponds to the displacement $x_R$ of the coil part about its mid-position, as depicted in FIG. 3, is indicated in millimeters (mm) along the vertical axis. As can be derived from the diagram, the driving force $F_R$ has a maximum value of 3.9 N. At the −3 dB value the displacement $x_R$ of the coil part is 2×5=10 mm.

A comparison between the diagrams of FIGS. 2 and 4 yields that the embodiment of FIG. 1 generates a higher maximum mechanical force, i.e. the driving force, than does the driving unit of FIG. 3 during energizing of the coil of the coil part. The maximum driving force is about 40% higher.

Moreover, the embodiment of FIG. 1 has an improved linearity of the driving force as a function of the position of the coil part, as appears from the −3 dB values. The linearity is about 30% higher. It is not improbable that both improvements are caused by the improved guidance of the magnetic flux due to the presence of the external magnetic pole elements in the driving unit in accordance with the invention, as all other essential aspects in the two depicted driving units are the same. The external pole elements decrease the stray component of the magnetic flux so that more flux can be linked to the coil of the coil part.

Figure 5:
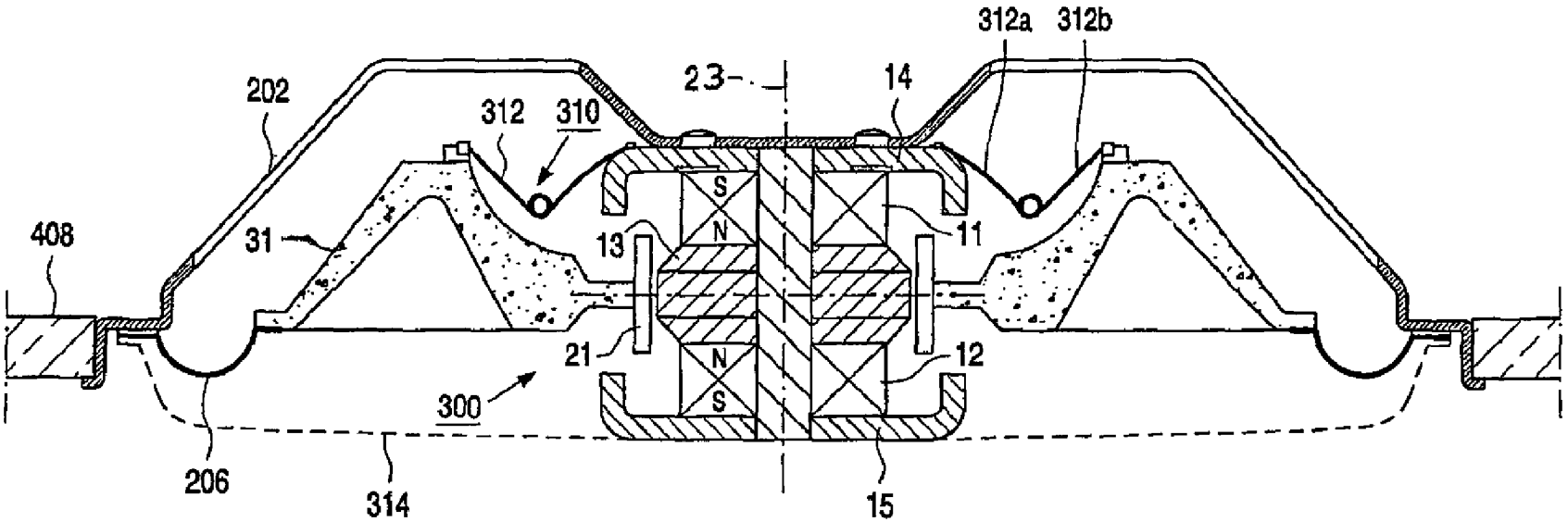
FIG. 5 is a longitudinal sectional view schematically showing an embodiment of the loudspeaker assembly according to the invention.

The embodiment of the loudspeaker assembly in accordance with the invention shown in FIG. 5 includes a frame or chassis 202, a diaphragm 31, and the electromagnetic driving unit shown in FIG. 1. This driving unit, here indicated by 300, is attached to the frame 202. The frame 202 may be mounted to a wall 400 of a built-in space or of a loudspeaker box or enclosure. The diaphragm 31 is fixed to the coil part 21 of the driving unit 300 at its inner side, and at its outer side it is connected to the frame 202 by means of a compliant mounting rim 206, e.g. an omega-shaped rim of a flexible material, such as polyurethane or rubber. In this embodiment, the diaphragm 31 is suspended with respect to the frame 202 at a location somewhere mid-way the coil part 21 and the rim 206 by means of a suspension device 310 of the kind disclosed in WO 99/66763, which patent application is herewith incorporated by reference. The device 310 comprises a set of blade springs 312 positioned around the translation axis 23. The blade springs 312 are each constructed as one bent blade spring having two spring portions 312*a* and 312*b*. At one side the blade springs are fixedly connected to a stationary body, in this example the external element 14, and at the other side they are connected to the diaphragm 31. It is to be noted that instead of the suspension device 310 it is alternatively possible to use any other suitable suspension means, such as a conventional spider device, e.g. made of a corrugated textile fabric.

It is further to be noted that the diaphragm 31, which in this embodiment functions as a piston, may have any suitable shape. Instead of the structured diaphragm body shown an entirely flat diaphragm may be used, for example. The loudspeaker assembly shown in FIG. 5 may be covered by a protection grille 314.

As was noted above, embodiments other than those depicted are possible; thus the invention is not limited to the embodiments disclosed herein by way of examples. The invention further relates to a loudspeaker unit comprising an enclosure with a loudspeaker assembly according to the invention.

The invention claimed is:

1. An electromagnetic driving unit for a loudspeaker assembly, comprising:

a magnet part, and a coil part having a single coil that is configured to be suspended adjacent the magnet part and translatable along a translation axis with respect to the magnet part, the magnet part including:

two permanent magnets that are configured to magnetically cooperate with the coil, an intermediate magnetic pole element that is sandwiched between the permanent magnets when viewed along the translation axis of the coil part, to form a single pole piece that includes a pole face that is magnetically directed towards an inner face of the coil, and two external magnetic pole elements, wherein:

the permanent magnets and the intermediate magnetic pole element are sandwiched between the external magnetic pole elements, and the external magnetic pole elements include pole faces that are magnetically directed towards an outer face of the coil.

2. The driving unit of claim 1, wherein the coil part is situated between the two external magnetic pole elements.

3. The driving unit of claim 1, wherein the coil includes a cylindrical coil having a coil axis that extends parallel to the translation axis of the coil part.

4. The driving unit of claim 1, wherein the two permanent magnets of the magnet part are magnetized in directions parallel to the translation axis of the coil part, the magnetization direction of the one magnet being opposed to the magnetization of the other magnet.

5. The driving unit of claim 1, wherein the pole elements are made of a ferromagnetic material.

6. The driving unit of claim 1, wherein the pole faces of the external magnetic pole elements are formed by edge portions inclining towards the coil part.

7. The driving unit of claim 1, wherein the pole face of the intermediate magnetic pole element includes an inclined surface that has a radial dimension from the translation axis that increases from the permanent magnets towards a central portion of the pole face.

8. The driving unit of claim 1, wherein the pole face of the intermediate magnetic pole element is a substantially convex surface.

9. The driving unit of claim 1, wherein the coil includes a cylindrical coil having a coil axis that coincides with the translation axis of the coil part.

10. A loudspeaker assembly comprising:

a frame, a diaphragm, and an electromagnetic driving unit that includes: a magnet part, and a coil part that includes a single coil that is configured to be suspended adjacent the magnet part and translatable along a translation axis with respect to the magnet part, the magnet part including:

two permanent magnets, an intermediate magnetic pole element that is sandwiched between the permanent magnets when viewed along the translation axis of the coil part to form a single pole element that includes a pole face that is magnetically directed towards an inner face of the coil, and two external magnetic pole elements, wherein:

the permanent magnets and the intermediate magnetic pole element are sandwiched between the external magnetic pole elements, the external magnetic pole elements include pole faces that are magnetically directed towards an outer face of the coil, and the diaphragm is attached to the coil part of the driving unit and is flexibly connected to the frame.

11. The loudspeaker assembly of claim 10, wherein the diaphragm is fixed to the coil part in an area extending between the two external magnetic pole elements.

12. The loudspeaker assembly of claim 10, wherein the diaphragm extends from the coil part in a substantially radial direction with respect to the translation axis of the coil part.

13. The loudspeaker assembly of claim 10, including an enclosure.

14. The loudspeaker assembly of claim 10, including a suspension device that is configured to support the diaphragm at an area between the coil part and an outer rim of the diaphragm.

15. The loudspeaker assembly of claim 14, wherein the suspension device includes one or more blade springs.

16. The loudspeaker assembly of claim 14, including a flexible connection between the outer rim of the diaphragm and the frame, wherein the suspension device provides a cantilevered support relative to the flexible connection to suspend the coil adjacent the magnet part.

* * * * *